US006802659B2

(12) United States Patent
Cremon et al.

(10) Patent No.: US 6,802,659 B2
(45) Date of Patent: Oct. 12, 2004

(54) ARRANGEMENT FOR AUTOMATIC SETTING OF PROGRAMMABLE DEVICES AND MATERIALS THEREFOR

(76) Inventors: Mats Cremon, Hemmenköp, SE-242 96, Hörby (SE); Pixie Ann Austin, 7714 74th Dr. NE., Marysville, WA (US) 98270; Patrick Helton, 6723 71st St. NE., Marysville, WA (US) 98270; Howard Nojiri, 6001 36th Ave. W. M/S 330, P.O. Box 4280, Everett, WA (US) 98203-9280; William Kelly, 6001 36th Ave. W. M/S 330, P.O. Box 4280, Everett, WA (US) 98203-9280; Steven Winter, 6001 36th Ave W. M/S 330, P.O. Box 4280, Everett, WA (US) 98203-9280; Duane Fox, 6001 36th Ave. W. M/S 330, P.O. Box 4280, Everett, WA (US) 98203-9280; Christopher Wiklof, 6001 36th Ave. W. M/S 330, P.O. Box 4280, Everett, WA (US) 98203-9280

( * ) Notice: Subject to any disclaimer, the term of this patent is extended or adjusted under 35 U.S.C. 154(b) by 0 days.

(21) Appl. No.: 09/911,530

(22) Filed: Jul. 24, 2001

(65) Prior Publication Data

US 2002/0191998 A1 Dec. 19, 2002

Related U.S. Application Data

(63) Continuation-in-part of application No. 09/249,879, filed on Feb. 16, 1999, now abandoned, which is a continuation-in-part of application No. 09/202,476, filed on Jan. 21, 2000, now abandoned.

(60) Provisional application No. 60/221,562, filed on Jul. 28, 2000, and provisional application No. 60/223,941, filed on Aug. 9, 2000.

(30) Foreign Application Priority Data

Aug. 4, 1997 (WO) ..... PCT/SE97/01322

(51) Int. Cl.[7] ..... B41J 11/44

(52) U.S. Cl. ..... 400/76; 400/61; 400/70

(58) Field of Search ..... 400/76, 70, 61

(56) References Cited

U.S. PATENT DOCUMENTS

| | | | |
|---|---|---|---|
| 4,369,361 A | 1/1983 | Swartz et al. | |
| 4,708,901 A | 11/1987 | Wood | |
| 4,716,438 A | 12/1987 | Farrell | |
| 4,872,027 A | 10/1989 | Buskirk et al. | |
| 4,876,571 A | 10/1989 | Nakamura | |
| 5,184,181 A | 2/1993 | Kurando et al. | |
| 5,266,968 A | 11/1993 | Stephenson | |

(List continued on next page.)

FOREIGN PATENT DOCUMENTS

| | | | |
|---|---|---|---|
| EP | 0 654 760 A2 | 5/1995 | |
| JP | 10044512 A | 2/1998 | |
| SE | WO 98/05508 | * 12/1998 | ..... B41J/29/393 |
| WO | WO 97/28001 | 8/2000 | |

*Primary Examiner*—Charles H. Nolan, Jr.
(74) *Attorney, Agent, or Firm*—Orum & Roth

(57) ABSTRACT

Method and apparatus for reprogramming a programmable product, such as, a printer, a wireless communication device, or a portable computer. A software programmable product that includes memory for storing product operation information and a method for configuring the software programmable products is provided. Software is configurable by data stored on an RFID tag. Data stored on the RFID is transferred reprogramming circuitry of the production which sets the configurable operating parameters. This configures the products features and options as desired by the specific user without requiring an external programming device or destructive entering into the packages or internals of the product. An RFID located in an electronic product, within or upon its packaging, or on an accessory may be loaded with reprogramming data such as media configuration data or usage data. The RFID reader may be located on a kiosk.

19 Claims, 9 Drawing Sheets

U.S. PATENT DOCUMENTS

| | | | | |
|---|---|---|---|---|
| 5,280,159 | A | | 1/1994 | Schultz et al. |
| 5,406,315 | A | | 4/1995 | Allen et al. |
| 5,445,463 | A | | 8/1995 | Paranjpe |
| 5,455,617 | A | | 10/1995 | Stephenson et al. |
| 5,480,238 | A | | 1/1996 | Nakano et al. |
| 5,488,223 | A | | 1/1996 | Austin |
| 5,495,250 | A | | 2/1996 | Ghaem et al. |
| 5,503,483 | A | | 4/1996 | Petteruti et al. |
| 5,521,674 | A | | 5/1996 | Guillory et al. |
| 5,534,890 | A | | 7/1996 | Krug et al. |
| 5,548,106 | A | | 8/1996 | Liang et al. |
| 5,564,841 | A | | 10/1996 | Austin et al. |
| 5,711,621 | A | | 1/1998 | Austin |
| 5,757,393 | A | | 5/1998 | Suzuki |
| 5,768,143 | A | | 6/1998 | Fujimoto |
| 5,774,146 | A | | 6/1998 | Mizutani |
| 5,826,328 | A | | 10/1998 | Brady et al. |
| 6,019,461 | A | | 2/2000 | Yoshimura et al. |
| 6,039,430 | A | | 3/2000 | Helterline |
| 6,099,178 | A | | 8/2000 | Spurr et al. |
| 6,123,024 | A | | 9/2000 | Williams et al. |
| 6,379,058 | B1 | * | 4/2002 | Petteruti et al. ..... 400/76 |
| 6,409,401 | B1 | * | 6/2002 | Petteruti et al. ..... 400/88 |

* cited by examiner

ARRANGEMENT FOR AUTOMATIC SETTING OF PROGRAMMABLE DEVICES AND MATERIALS THEREFOR

CROSS REFERENCE TO RELATED APPLICATIONS

This application is a CIP of U.S. patent application Ser. No. 09/249,879, now abandoned, which is a CIP of U.S. patent application Ser. No. 09/202,476, filed Jan. 21, 2002 now abandoned, which claims priority from PCT/SE97/01322 filed on Aug. 4, 1997. Additional matter claims the benefit of U.S. Provisional patent applications No. 60/221,562 filed Jul. 28, 2000 and No. 60/223,941 filed Aug. 9, 2000.

BACKGROUND OF THE INVENTION

1. Field of the Invention

This invention relates to an arrangement for reading a code to initiate the automatic setting of printers and other electronic products, and more particularly, for example, to the setting of operation and/or printer mode/feature parameters, data communication protocols or printing layout formats. The code to be read may be an RFID affixed directly onto material to be used in the printer or other electronic products, or onto separate sheets, labels or purchasing materials. This invention also relates to materials and dyes, to be used together with a printer. With the aid of the present invention, an optimum setting configuration of the printer or other electronic products is automatically obtained, entailing a high quality and making the printer or other electronic products easily usable by untrained users.

The present invention replaces the previous methods of configuration and programming, as well as bar codes, with RF tags. RF tags, also known as RFID tags, respond to radio frequency (RF) fields. The RF fields energize the RFID tags with enough energy to allow them to transmit/reflect data encoded thereon. RFID tags need only be placed in proximity to the printer or programmable electronic product incorporating an RF reader/interpreter to be read, and the data stored therein captured and uploaded for configuration of the printer or other programmable product. RFIDs may be written to at time of manufacture, by RF signal and/or direct coupled logic circuitry.

2. State of the Art

Previously, configuration of printers, accessories and other programmable products required the use of extensive data entry at a user interface of the product, replacement of data chips within the product, or attachment of cables between the product and a host computer or dedicated programming device. These procedures require technical skill, and in some cases dedicated service personnel. Often reconfiguration is required with each change of media, as different labels of changing sizes, roll capacities or printing parameters are used.

Previously, it was suggested that bar code data could be delivered with each media roll, which could be scanned and the data taken directly into the printer or programmable device so that reprogramming and configuration could occur. An example describing this method/system is U.S. Pat. No. 5,488,223, incorporated herein by reference. '223 requires a separate optical scanning system to be installed in the printer, and extra care taken as the media must be exposed to the scanner in a proper way to get a correct reading of the data.

The common methods used to change the configuration of a printer or other software programmable product require that the product be removed from its container and packaging to allow a qualified service technician to either:

1) Remove the electronics cover and replace memory components containing product configuration information, or
2) Connect the product to electrical power and a host computer or other dedicated programming device which is used to download, via a communication interface, new configuration parameters to the programmable memory components in the product, or
3) Connect the product to power and enter codes/commands via a user interface.

These alternatives are time-consuming and costly due to the need to open cartons, remove packing material, and prepare the products for reconfiguration. For example 1) above, removal of product electronics covers usually cannot be done by end users without voiding warranties. For alternative 2) above, electrical power and access to a reprogramming device may not be available in the warehouse area where products are stored. In all cases, it is likely that the packaging cosmetics will be damaged during the unpacking and repacking process. Printer and other software configurable product manufacturers, distributors and value-added resellers who must provide their customers with a product which has been configured to provide a specific set of features and options desired by a specific customer may be required to build and carry in stock, all possible configuration options. This is impractical and cost-prohibitive.

In the past, the setting of the printer or other electronic products was often performed by manually entering parameters using an operator input keypad or a keyboard connected to the printer/device, or by data transfer. There are, however, many parameters to be entered, and the parameter determination and entry protocol is often complicated, implying that frequently the user may not to be willing and/or able to perform a correct printer setting him or herself. Furthermore, some parameters are factory set and can only be changed by a qualified service technician. The result is that the quality of the printed product will be less than optimal.

Within other technical areas, coding has been used for the setting of various devices. As an example, programming of video recorders with the aid of bar codes, setting of cameras via reading electrical contact codes on film cartridges, setting of audio tape recorders by sensing cavities on the tapes, etc. It is not known, however, to control a product via codes in the way that the present invention teaches, to program a product without opening the packaging or to have any accessory products used with the product automatically configured by proximity detection.

The present invention resolves the problem of setting the product via affixing a code onto, or in connection with, materials to be used together with the printer. The code may be read automatically or through a simple manipulation performed by the user.

Owing to the invention herein, an optimum setting of the product is achieved fully automatically or semi-automatically. This means that, in the case of printers, ease of use and a high print-out quality can be warranted. The invention allows for quick and easy exchange of dye and receiver material with an automatic or semi-automatic optimal setting of the printer work parameters with regard to the dye as well as to the receiver material. Furthermore, other printer functions, such as data communication with peripheral equipment, printing layout, automatic recognition of attachments and wireless status reporting without local RF transmitter power connection can be controlled in a simpler manner.

SUMMARY OF THE INVENTION

The present invention is an arrangement for the automatic setting of a programmable product. In the case of printers, the arrangement includes a printing mechanism and a control unit for providing a printout on a printing material with the aid of a dye, ink or toner. In accordance with the invention, a code reader is connected to the control unit for reading a code for controlling at least one parameter of the printer means i.e. the software controlling product operation. Alternatively, the code may be associated with the printing material, the dye, a printer means peripheral device, wireless status reporting, or a printing layout.

The present invention allows the factory to build a standard, generic configuration that can then be reconfigured without reopening the packaging. Reconfiguration may take place at the manufacturer's factory, warehouse, at a distributor or a var, upon delivery to the end user, or at any time during the products service life.

The product is capable of reading an RFID programming tag without requiring any external programming device or destructive entry into the packaging or internals of the product. The product may utilize an onboard RF antenna and interrogator circuitry. Configuration data taken from the RFID tag is then read into the product, which contains reprogrammable memory components which are reprogrammed according to the data received from the RFID tag. The reprogramming configures the product's features and options as desired by that specific user. This feature eliminates the requirement of a dedicated programming device or host computer at the point of product installation. Also, since no intrusion into the electronics' cavity is needed, a qualified technician is not required, nor is the product warranty likely to be voided by removal of safety regulated electronics enclosure covers. Specialized skill or training is not required to execute the reconfiguration procedure.

The emergence of software programmable products such as on-demand label printers, into which there is built in, the ability to read and encode RFID tags or labels using an RF antenna, encoding and decoding electronics, permits human optical, machine-readable, as well as RF encoded information to be incorporated into an on-demand tag or label. These products provide circuitry and apparatus that can be adapted to the present invention without a large additional expense. Similarly, other software programmable products, for example, cellular telephones and wireless enabled data or computer devices have receiver/transmitter circuitry that could be adapted to read and/or encode RFID's. The present invention may use this circuitry to read and or write to the reconfiguration data on an RF tag, or receive RF data directly into the product's circuitry via an onboard RFID circuit.

Upon review of the following specification and claims, one skilled in art will realize that this invention is applicable to any electronic product that uses embedded software.

BRIEF DESCRIPTION OF THE DRAWINGS

The invention will be described in detail below, with reference to the drawings, in which.

DETAILED DESCRIPTION

Figure 1:
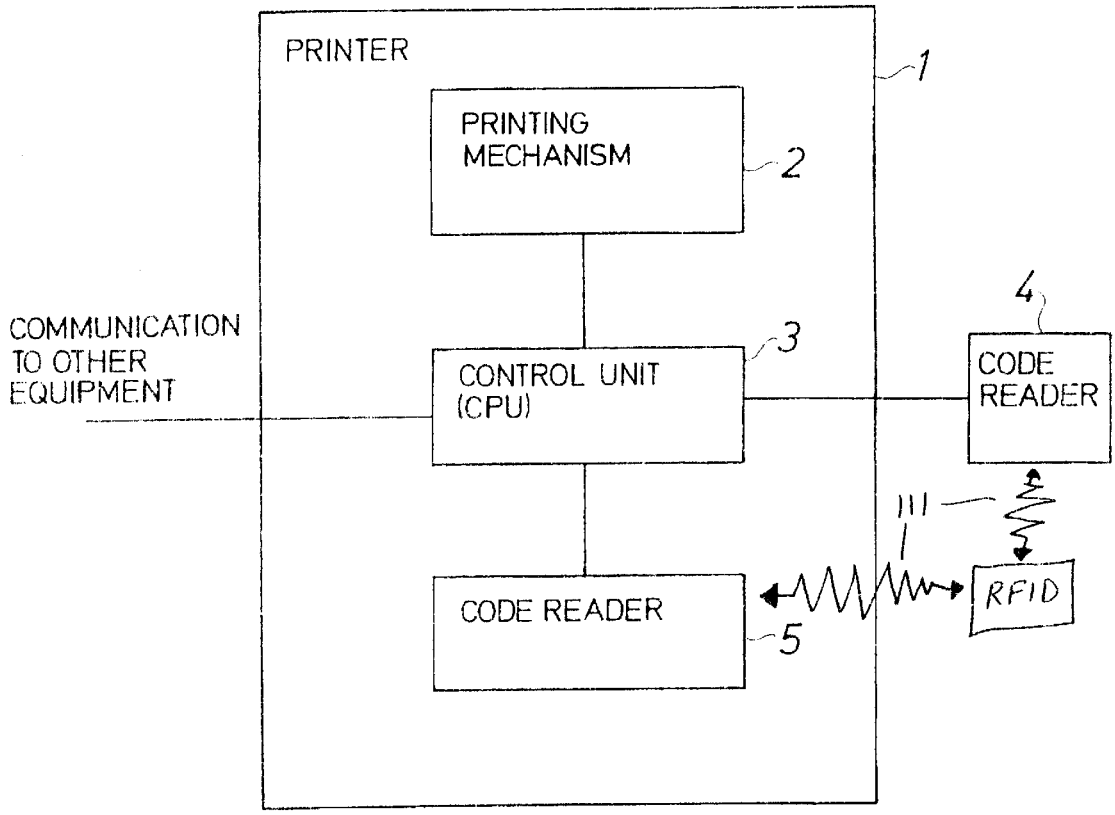
FIG. 1 is a general block diagram showing the arrangement according to the invention.

The invention will initially be described in detail with reference to a preferred embodiment of the invention, as illustrated in the drawings. The principle may be applied various ways, as described below. A printer, as shown in FIG. 1, comprises a printer housing 1, containing a printing mechanism 2 performing the actual printing. For clarity, mechanical components of the printer are not shown. In the embodiment example shown, the printing mechanism is the thermo-transfer type, i.e. the printing mechanism includes a printing head having heated points or dots (not shown). The dots act on a heat-sensitive dye or transfer ribbon which transfers dye to a receiver material, normally paper, but synthetic materials are also commonly used. The paper may be a single layer or comprised of a carrier or back paper carrying labels or tickets to be printed. The paper may be linerless paper. The term linerless paper is known in the art to include any media which has an adhesive, especially a pressure sensitive adhesive, but does not require a discardable locking or support layer. The receiver material may come in the form of a roll, loose sheets, or a continuous web. The transfer ribbon is delivered as a roll which is fitted into the machine and wound past the printer head. Printing mechanisms of this type are well known in the trade and do not, as such, constitute any part of the invention.

In order to achieve an optimum printout result, it is of utmost importance that the transfer ribbon dye, the receiver material, the temperature of the dots and the printing speed, are correctly adapted to each other. The wrong materials and erroneous printer settings are, regrettably, often one of the most common causes of a bad or unsuccessful printing result. A correct printer setting and a correctly chosen printing material will also prevent overheating, which might otherwise easily cause damage to the printer head, leading to a premature exchange thereof. A universal ribbon having an optimal print-out quality over the full range of available media, and fitting all printers, is impossible to develop.

For the thermo-transfer technology it is especially important that the transfer ribbon and the receiver material are adapted to each other. Thus, the various parameters of the printing mechanism must be correctly set. A central processing unit (CPU) or control unit 3 controls the printing mechanism, which may be microprocessor based. In order to feed the correct parameters to the control unit in accordance with the present invention, a code reader 4 and/or 5 is used.

The invention also relates to reading from and writing to RFID's in a printer or other programmable device. Codes stored in Radio Frequency (RFID) tags or labels 6 may be read via radio waves 111. RFID's are comprised of metal layers constituting electronic components. When subjected to a radio frequency magnetic field, emitted by the code reader, they answer with a frequency/reflection comprising code stored on the RFID.

The RFID tags may be located at the exterior and/or inner ends of, for example, rolls of printing and dye material rolls. The tags may also be located at the exterior or interior of the cores of such rolls. It is especially advantageous if each label to be printed contains an RFID tag 6.

Figure 7:
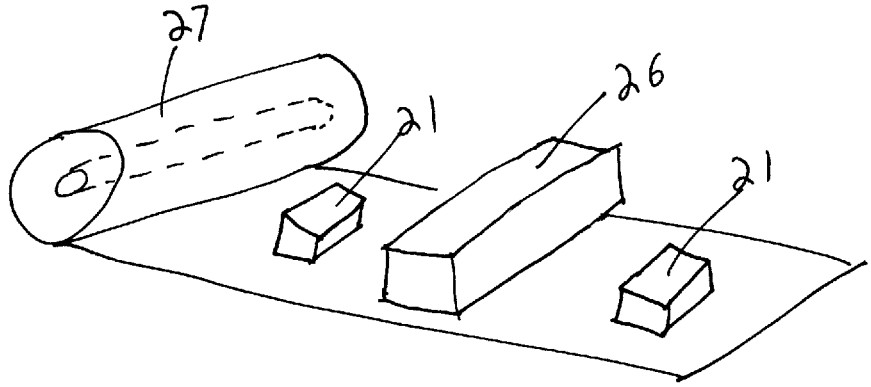
FIG. 7 is a schematic diagram illustrating various locations for the RF code sender/receiver.

An RFID code reader and writer is coupled with the printer. Also, the RFID code reader may optionally have RFID write ability. As shown in FIG. 7, the RFID code reader 21 may be associated with the printer somewhere between the material roll 27 and a printer head 26. It may also be located after the print head 26, in which case the label and printing material may be fed back for printing after reading from or writing to the RFID tag. The RFID code reader may also be orientated so that placement of an RFID on or near a specific location on the product housing 1 enables reading of and/or writing to the RFID.

A code is read from the RFID tag. The code is used in various ways; for setting of various parameters of the printer; for controlling the layout of the labels printed; for controlling the text to be printed on the labels; and for controlling the data communication with other equipment. Also, data may be read for sending to external computers. The setting of the printer or other parameters, the layout and text may vary from one label to the next.

Data may also be written to the RFID tags. The data may be generated by an external computer or other source or by the processor of the printer as a response to system status or information read from the tag. The data may contain various kinds of information, e.g. product information, control data for reading other equipment, such as luggage handling equipment in airports, expiry of foods stuff, etc.

In one embodiment, the RF tags are associated with luggage identification labels provided to an airline or other transportation passengers. By the present invention, a means for printing RFID tags for each passenger and each piece of luggage is provided, which allows for successively printed labels to contain information unique to each passenger and each piece of luggage. Information such as passenger name, address, and contact information, destination of the luggage, present and past locations of the luggage, luggage weight, and any other relevant information may be uniquely recorded for each tag, and may be updated, read, and/or corrected to provide a complete up to the moment history of the movement of the luggage. In this way, many of the typical problems with lost and delayed luggage can be minimized or eliminated.

Information about each piece of luggage may be easily retrieved and/or updated at anytime without the need to manually, visually inspect or contact the luggage tag with a light beam. Mass monitoring of large groups of luggage is possible, for example, by retrieving information on all luggage on a particular flight to ensure that each item correctly has the next destination of the aircraft as a proper intermediate or terminal destination.

Information contained in the RFID tag of an individual piece of luggage may be read and used by a printer according to the present invention, forming a part of a luggage handling system, such that the luggage handling system is controlled to route the piece of luggage through the system. Thus, the printer may function as an input/output device of various kinds of control and management systems.

This embodiment includes a code reader which emits a signal to the RFID tag to stimulate a transmission back from the tag which includes the relevant data. The code reader may be a reader/writer which may read the code as set out and may also write to the tag, adding or changing the information on the tag.

In this embodiment, the steps of reading the tag and writing initial information to the RFID on/within the tag, and also printing the information on the tag, and subsequently reading, the tag, altering as necessary the information on the RFID portion of the tag, and also printing updated information on the tag may be accomplished by the reader/writer means described above. The reader/writer is capable of performing these steps, in connection with the other printer components for successive on a print roll or other input material, each of the tags containing unique information as compared to neighboring tags. The code reader may be external 4 and/or be complemented by an internal code reader 5, or vice versa, as will be explained below. The code reader reads a code, in the discussed example illustrated by an RFID 6, which is provided in connection with the transfer ribbon, receiver material or separately.

In another embodiment, the code is pre-printed or affixed directly onto the start/end of the dye ribbon roll and/or the roll of receiver material. When such rolls, respectively, are fitted into the printer, the internal code reader is utilized. Reading of the code at the beginning of the roll is initiated before any print-out has been performed. Thereby, the printer is immediately set for optimum printing quality.

An alternative is to code, pre-print and/or pre-manufacture a label, which is then glued onto the roll for reading. This may be useful when using dye ribbons or paper of a known quality, but without a pre-printed code. There might be a large stock of older paper that one might want to use, or it might for some reason become necessary to change dye ribbon or paper in the middle of a roll.

In the above case, only the internal code reader 5 was used. The printer according to the invention however may also include an external code reader 4, that may be used for reading from e.g. separate sheets comprising RFIDs for various possible configuration, modes, paper and dye ribbon qualities. A printer manufacturer could for example enclose a sheet multiple listing dye ribbon and printing data/codes from different manufactures, in order to make his printer flexible and not confined to certain manufacturers. The materials manufacturer obtains the same advantage of increased flexibility, as his material will not be confined to a certain printer.

Another suitable location for affixing the code may be on a material packing. This is especially preferable when the printing material comes in sheets rather than on a roll, and when the dye consists of ink or dye powder that is not suitable in itself to carry the code. The code may, in this case be read either internally, if the package or a part thereof is fed into the reader, or be read by the external code reader.

Alternatively, the internal code reader may be powerful enough to capture all RFIDs in a range, for example, within the enclosure or externally within one foot, and then sort between them for any new information.

The printer set up may be automatically adjusted by the signals processed by the reader/writer, in order to accommodate successive tags having different physical characteristics.

In an embodiment of the invention, a printer means has one or more printer operating parameters associated with it, the printer means also includes means for depositing a dye or other print material, in a conventional manner. The printer will also be associated with a central processing means, and a RFID code parameter sending and receiving means. In operation, a signal may be received from an RFID tag by the RFID code parameter sending and receiving means. This signal may then be sent to a separate processing means which interprets the signal, and may change the signal into a second signal, which may be sent to the printer. The first signal from the RFID code tag may indicate to the printer the printer operating configuration which must be used, or may also include information about a particular print job, or what is to be printed on the receiving material. In this way, unique information from each item to be printed may be analyzed and utilized by the printer to produce a unique printing job. In another embodiment, a RFID code parameter may be sent from the printer, the central processing means, or the RFID code parameter sending and receiving means, back to the RFID tag, to modify information on the tag. In this way, the RFID tag may be constantly updated to include all relevant information which may be used at the present moment, or at some point in the future.

In one embodiment, the RFID code parameter and receiving means is located functionally between the material roll and the printer head.

In another embodiment, signals from the RFID code parameter sending and receiving means may be sent to an external computer or computers, or to other equipment which may receive signals from those items or computers, for example, in order to control the print jobs.

Figure 3:
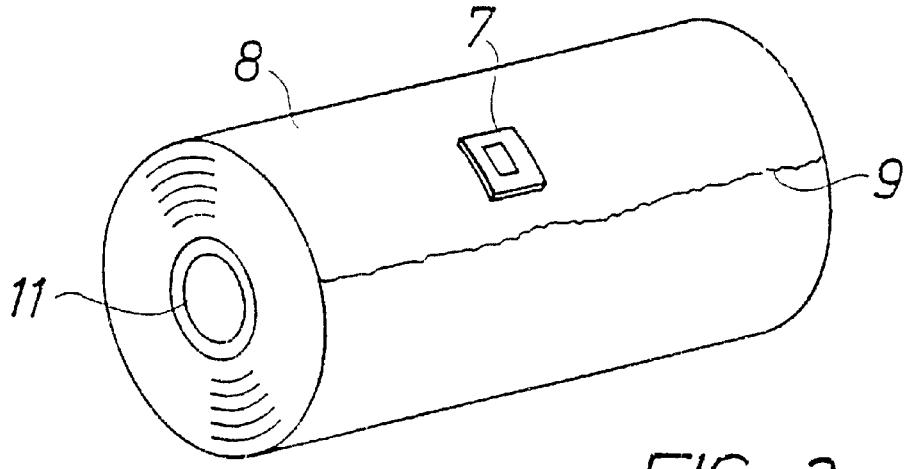
FIG. 3 illustrates a material onto which a code has been applied in accordance with an embodiment of the invention.

In one embodiment, the RFID code tags may be disposed on the internal first row end, the external first row end, or the first roll core. FIG. 3 shows an embodiment of the arrangement according to the invention where an RFID tag 7 is positioned at the beginning of a roll of material 8, i.e. at the exterior end 9 of the roll. The RFID tag is read automatically by an integrated RFID code reader or semi-automatically by an external code reader.

Figure 4:
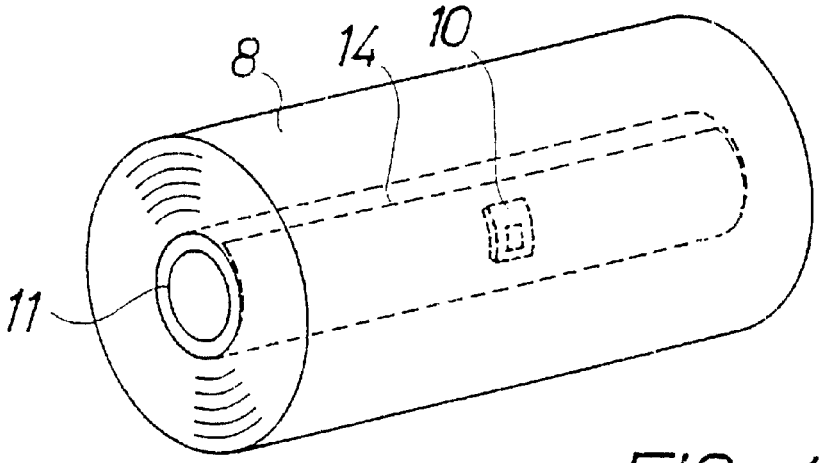
FIG. 4 illustrates a material onto which a code has been applied in accordance with another embodiment of the invention.
Figure 5:
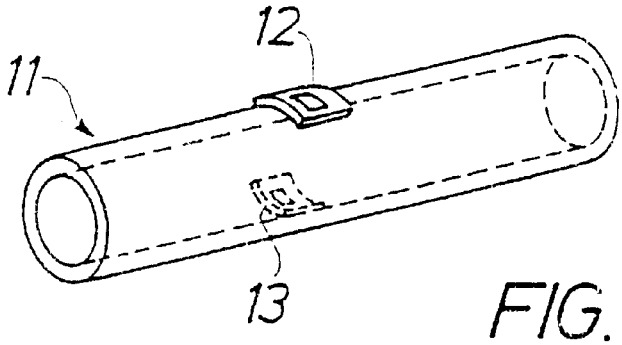
FIG. 5 illustrates a core of a roll of material, onto which a code has been applied in accordance with a further embodiment of the invention.

As shown in FIG. 4, a RFID tag 10 may alternatively be positioned at the inner end 14 of the roll. i.e. adjacent the core 11, or support, upon which the material has been wound, the reading is electronic, reading through the material can be performed without problems. One advantage with this location is that the RFID tag 10 is completely protected and there is no risk of accidentally falling off or being torn off.

A further variant is to place an RFID tag 12 directly on the outside of the core before winding the material on, or an RFID tag 13 on the inside of the core 11. The RFID tag can be placed on the inside also when the material has already been wound onto the core. A RFID chip with die cuts around it on the media roll or media itself is removable and recyclable.

The invention may also be applied to other types of printers. Direct thermo-printers function in a similar manner to thermo-transfer printers but utilize no transfer ribbon. Instead, the printing head is allowed to apply heat directly onto a heat-sensitive paper.

Ink jet and laser printers use ink and carbon powder, respectively, as dye, which is supplied in cartridges. The printers may need adjustment for writing on special materials, e.g. metal and plastic resins. Code may be easily applied e.g. on the ink or carbon powder package, as mentioned above.

Information included in the RFID tag could be the proper printer settings for the given media, for example: direct thermal or thermal transfer, paper or plastic, linered or linerless and/or label dimensions. The information would instruct the paper, for example, to use reverse printing protocol if printing on the back of a clear label for reverse viewing. The information could include the exact number of labels included in each media roll, so that the printer could signal the operator for reloading prior to running out of media. Similarly, the RFID tag could be located on or in the printer ribbon roll, where ribbon specific information could be encoded. Read/write capable RFID's on media rolls would be able to record the exact number of media remaining allowing partially used media rolls to be swapped between printers without loosing count of the media remaining on each roll. Another place for the tag would be in or on the shipping carton.

There are commercially available readers of different configurations that can be used with the present invention. The readers, may be internally integrated, external or hand held. The external reader may be mounted on a stand, or be fixed in the form of an RF target on the side of the printer, for reading by placing the code proximate the RF target within a suitable distance.

In the embodiment described above, the printer has been set mainly with regard to the printout quality. However, the invention is not intended to be limited to this only, but the reading may also be used for controlling the data communication between the printer and its peripheral equipment, such as baud rate and number of bits, and printing layouts. For a printer which is to print labels in various standard formats and with varying texts, the printing can thus be controlled by a simple reading of a code from a "ready-reckoner", best done using an external reader 4. The code constitutes a command to the control unit or to an external computer, controlling the printing layout.

Figure 6:
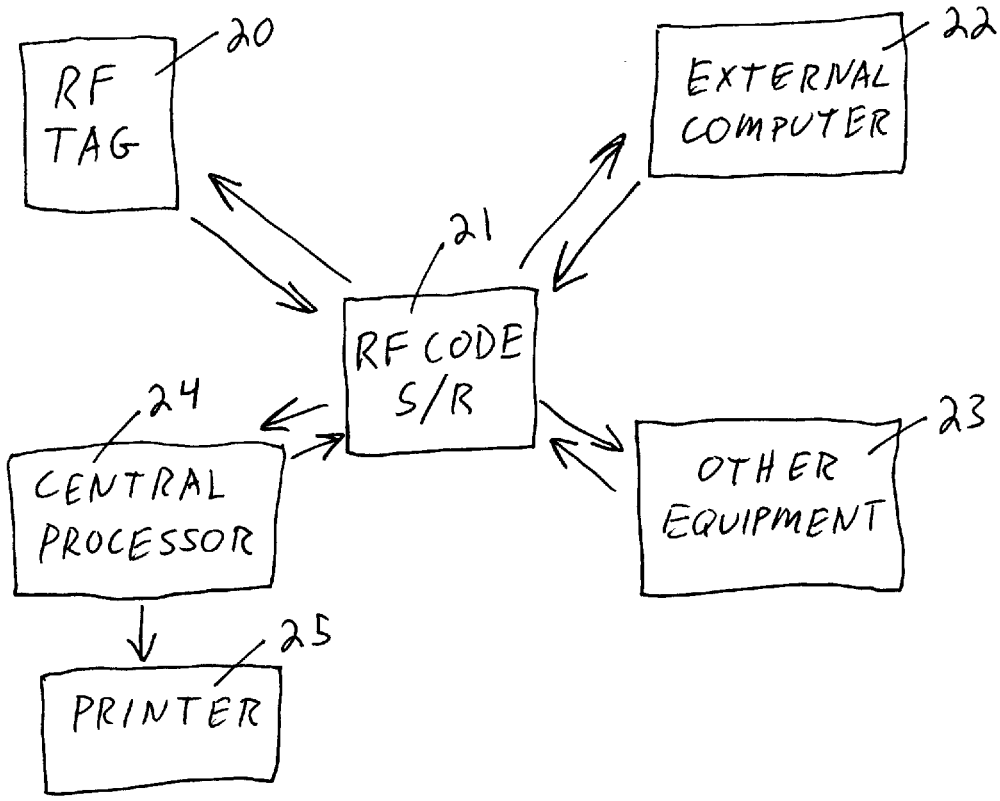
FIG. 6 is a block diagram illustrating the RF tag information signal paths.

FIG. 6 illustrates the signals and their paths between the RF tags 20, the RF code sending and receiving means 21, the central processor 24, the printer 25, the external computer 22, and other equipment 23.

FIG. 7 illustrates possible locations of the RF code sending and receiving means 21 with respect to the material roll 27 and the print head 26. For clarity, mechanical components of the printer 1 are not shown.

Figure 2:
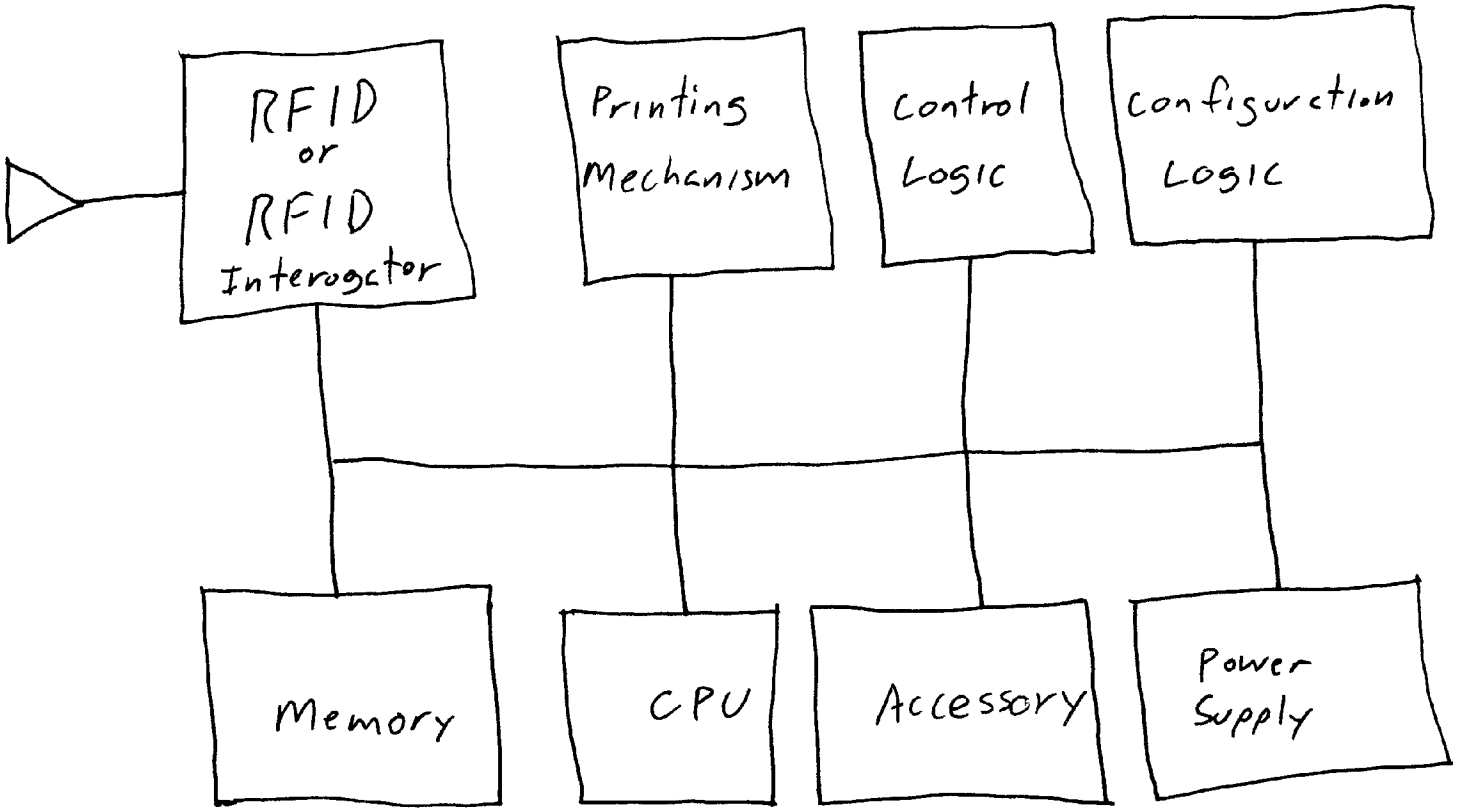
FIG. 2 is a higher detail block diagram of a printing system according to the present invention.

When an RFID 6 containing configuration data is brought near or placed into the printer 1, the RFID Interrogator 5 or 4 is activated and the data on the RFID 6 read by means of an RF field 111. The data read from the RFID 6 is passed by the RFID Interrogator 5 or 4 to controller 3 which processes the data, placing it in appropriate registers or memory locations, thereby configuring the operating parameters of printing mechanism 2. As shown in FIG. 2, the internal components of the printer are interrelated. The RFID reader or RFID may pass to or receive data from a printing mechanism, control logic, configuration logic, memory, the CPU, accessories, the power supply or other components.

Figure 8:
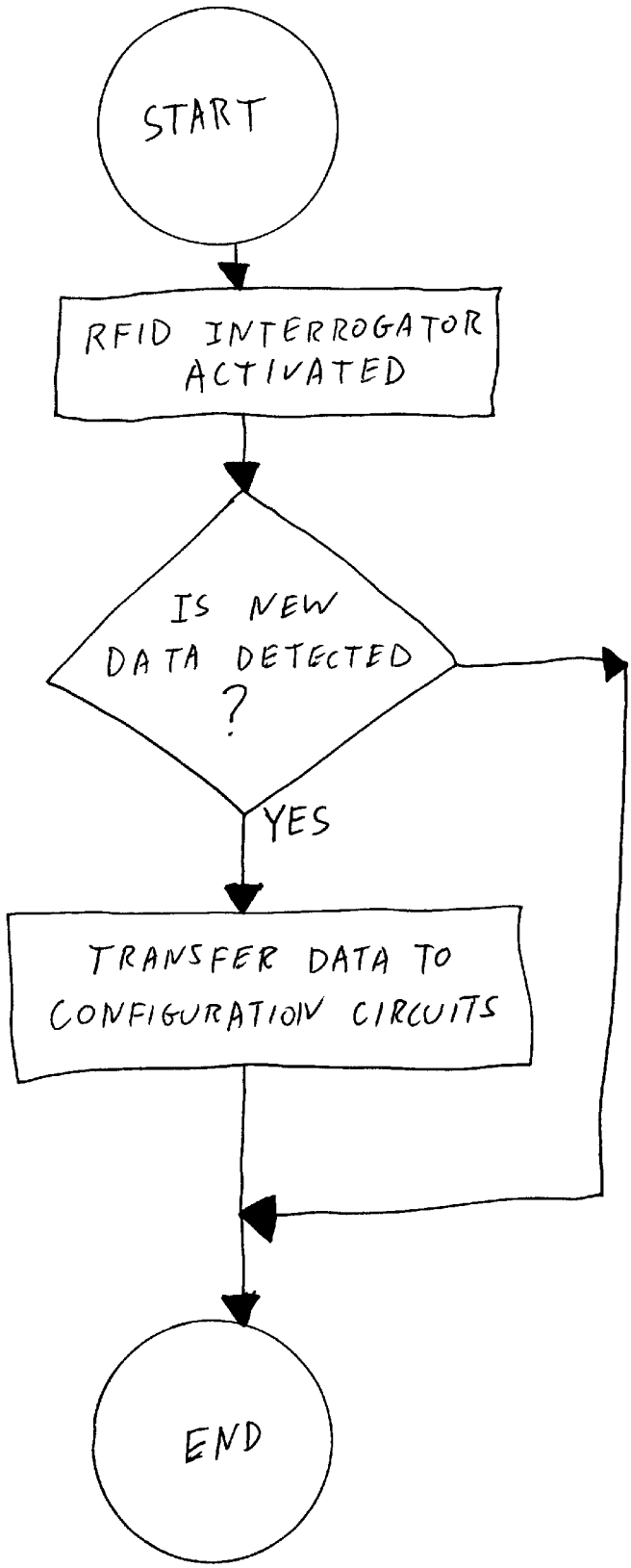
FIG. 8 is a flow chart of the reconfiguration method of the present invention.

Activation of the RFID Interrogator 5 or 4 may be by several methods. For example, it may be activated every time the printer case is opened and closed, or by operator command from the printer's user interface. As shown in FIG. 8, if no RFID's are within range or no new data is recorded, the previous or default configuration settings may be used.

RFID tags may be attached to device peripherals or accessories, for example an automatic label cut-off printer attachment. When the RFID on the peripheral is close enough to the device to be read by the RFID Interrogator 5 or 4, the device reads the data on the RFID and reconfigures itself to operate in conjunction with the new peripheral.

RFID's permanently mounted on printers and other programmable products may have read/write capability. In this case, the RFID Interrogator 5 or 4 has write ability allowing it to write to an RFID and then interrogate it to verify that the updated data has been accurately encoded. These RFID's, updated by their host device, could then be queried by a local interrogator, whether the host device is energized or not, allowing reporting of all devices within signal range for inventory control, repair scheduling, operational status and/or consumables usage reporting.

In the case of a printer, to initiate reprogramming, the user would only be required, for example, to place a new media or printer ribbon roll into the machine and close the cover. As a part of the boot routine upon reloading, the printer would energize the RF reading and interrogation circuitry to try to detect an RF tag within or proximate to the enclosure. If present, the data is read and reconfiguration initiated. If not, the printer would either request confirmation through its user interface of the user, or continue with the settings already present in the printer. Links to the firmware of the printer or other programmable device would be similar to those disclosed in U.S. Pat. No. 5,488,223 hereby incorporated by reference in its entierty. Continuing as if the "host computer" of '223 was the RF tag reader/interrogator module, the download data would flow into the proper registers of the printer or programmable device to reconfigure it.

In other embodiments, the present invention may be applied to any programmable product. Printers, cellular telephones and wireless enabled data or computer devices, like other software programmable products, have the ability to have many of their features and options executed and enabled in embedded software located within the product. Depending on a specific user's needs, these features and options can be selectively enabled to provide a customized product configuration. A problem arises when a product has been built and packaged into a specific or generic configuration that is different than the one desired. Presently, the product may require removal from the packaging, electrical connection of a programming device containing the code required to reconfigure the product, and then downloading and reconfiguration of the memory of the product by a qualified service person. The present invention eliminates these problems by providing a programmable RFID tag or label located on or within the product's packaging or even permanently located in the device's electronics, so that this tag or label could be remotely programmed to contain the necessary code to enable specific features and options desired by the end user for that specific unit. The specific configuration information would be transmitted to the RFID tag from a programming box containing an RF transmitter tuned to energize and program the RFID tag or label. Alternatively, the RF circuit may be supplied with electrical or capacitative contacts for programming under direct or capacitative connection with the programming box.

Upon receipt by the user, the product is unpacked, energized, and then the preprogrammed RFID tag or label positioned in or near the product adjacent to an RF antenna and interrogator device. The data contained in the RFID tag or label includes all information required to program the product with a specific set of configuration parameters as described in the RFID tag or label which updates the product's firmware.

To ensure that the RFID tag will only be used to reprogram a specific product, the tag may be encoded with data relating the configuration information to a specific serial number of a product. Also, the RFID tag may be programmed to limit the number of downloadings of its configuration information.

Figure 9:
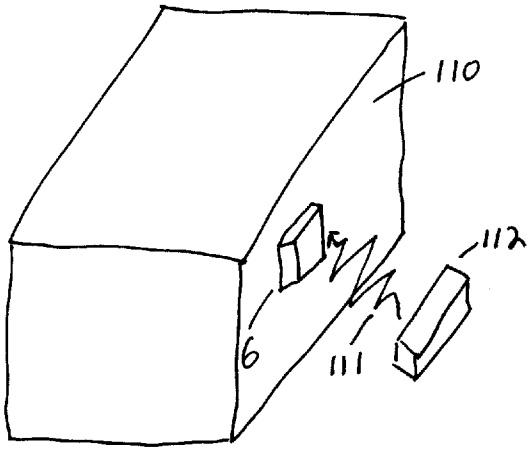
FIG. 9 is a representation of a packing carton with RFID tag and a RFID programming device.

FIG. 9 shows an RFID tag or label 6 installed on or within the packing carton 110 but outside of the product to be reconfigured. The carton is positioned so as to present the surface-mounted or proximate located RFID tag parallel and in close proximity to the antenna of the RFID programming device 112. The RFID programming device 112 has been loaded with the desired features and options configuration information for that unit. To transfer the configuration information, the RFID programming device 112 transmits a signal 111 which activates the RFID tag 6 and programs it with the configuration information. The RFID tag may be integrated into the product and similarly programmed. This may require identifying a target area on the package to direct the programming signal onto the area of the RFID. Alternatively, higher power interogators may be used.

Figure 10:
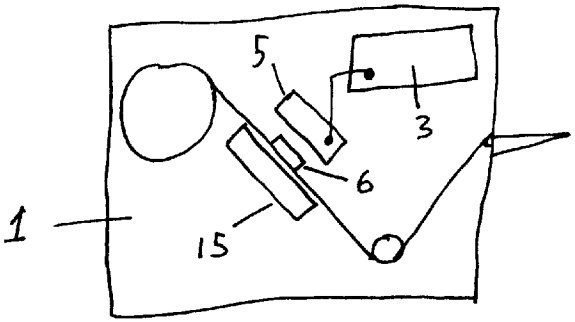
FIG. 10 is a schematic of internal components of a printer, related to reconfiguration via RFID.

FIG. 10 represents one method of reprogramming the product, in this case a printer 1. The programmed RFID tag 6 is removed from its holder on the carton 110. The printer 1 is unpacked, powered-up, and the RFID tag 6 placed close to the antenna of the RF interrogator 5. The RFID tag 6 is read by the RF interrogator device 5, which is electrically connected to the CPU printer electronics 3. Data transmitted from the RF interrogator 5 then causes the printer 1 to enable the reconfiguration process which results in the new configuration parameters being loaded into the printer firmware.

FIG. 10 shows the RF antenna 5 and decoder electronics positioned in the media supply path of the printer 116. In this embodiment, the RFID tag is passed through the media supply path 116 as if being printed, and as it passes it is read. RFID labels 6 may be placed in the media supply and/or printer ribbon rolls, where the RFID tag 6 is read as a new set of labels or ribbon is placed into the printer. This will allow each roll to configure the printer for that specific roll. This would mean the printer could be told what size labels are present and/or the number of labels that are in a roll, allowing the printer to call for reloading before running out of labels and causing down time, and/or specific printing parameters for each specific media, for example the thermal settings or reverse printing mode.

Figure 11:
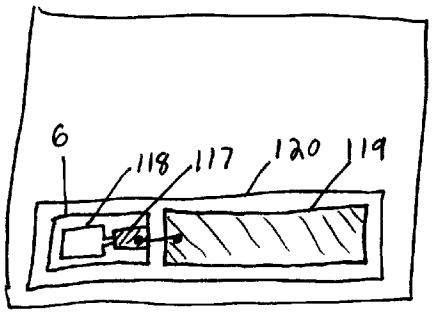
FIG. 11 is a schematic of a printer with an RFID circuit mounted on the printer motherboard.

Another embodiment, as shown in FIG. 11, uses a direct link between an RFID tag 6 with electrical contacts and the software programmble product electrical circuits 119. An RFID tag, reprogrammed insitu remotely or while on or near the outside of the carton, has electrical contacts which mate via a socket to a hard wired connection to the electrical circuits 119. When connected, the configuration parameters are downloaded. In addition, the RFID tag of FIG. 11 may be integrated into the software programmble product itself, with the RFID chip 117 and antenna 118 a permanent, hard wired, part of the electronic device motherboard 120. RFID chip functionality may be integrated into or combined with other chips and or circuitry on a motherboard 120.

Figure 15:
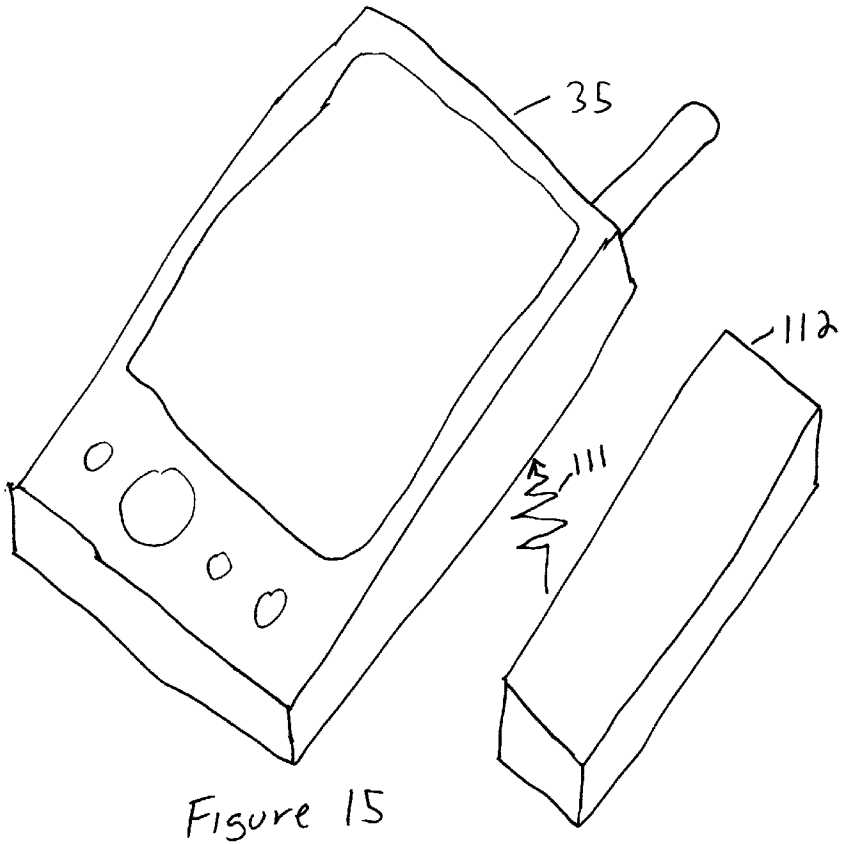
FIG. 15 is a representation of a software programmable product with wireless communication capability with a built-in RFID circuit and an RFID programming device.
Figure 14:
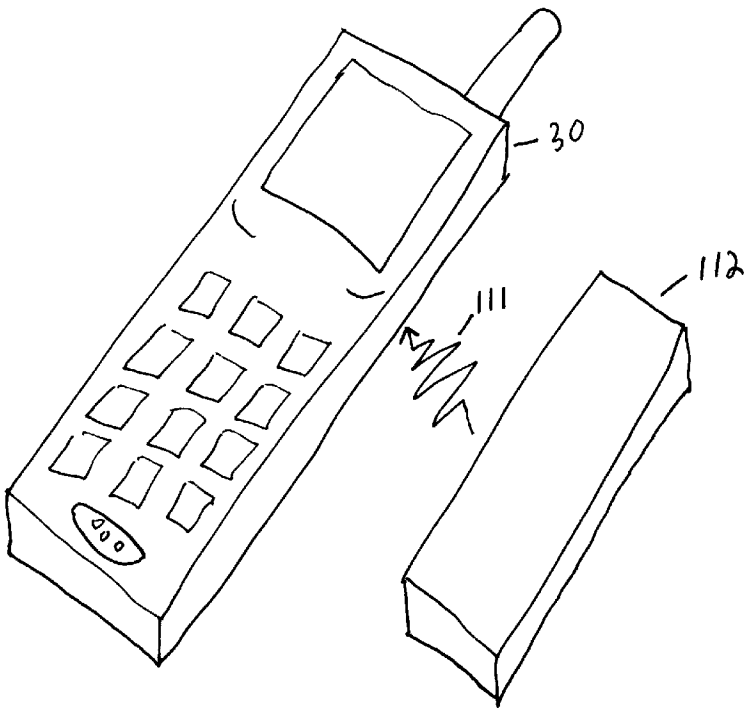
FIG. 14 is a representation of a cellular telephone with built-in RFID circuit and an RFID programming device.

The software programmble product with RFID tag integrated into it may, for example, be a cellular telephone 30 or other form of wireless communication capable electronic device 35 as shown in FIGS. 14 and 15. Wireless devices of this type require programming to associate them and the user to the wireless network they will be used with. Currently, these devices require connection of a dedicated programmer by trained personnel, the present invention would allow programming by untrained personnel or even by the purchaser at, for example, an ATM style kiosk that would include an RFID programming device 112.

Figure 12:
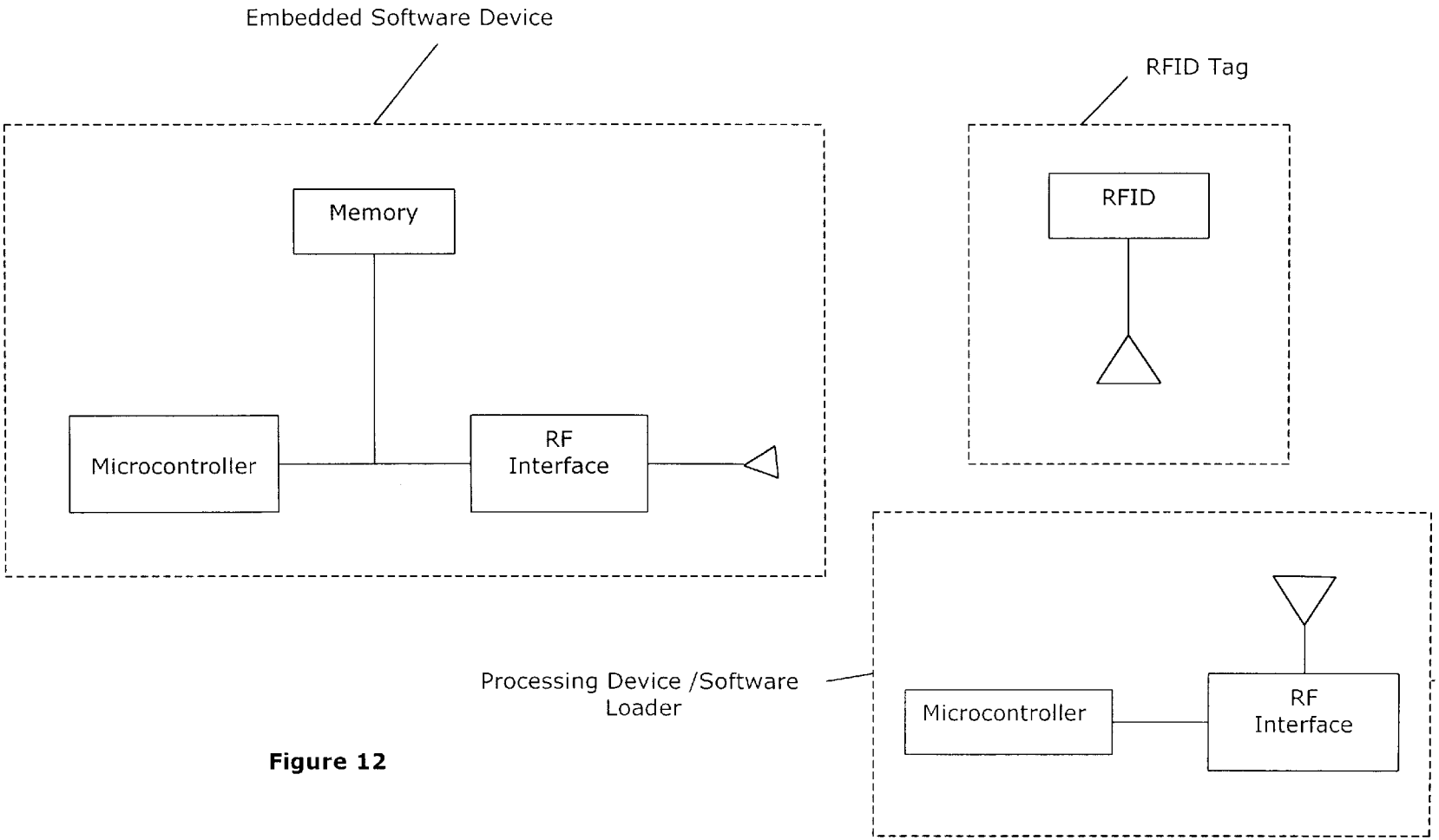
FIG. 12 is a block diagram of an embedded software device programming system.
Figure 13:
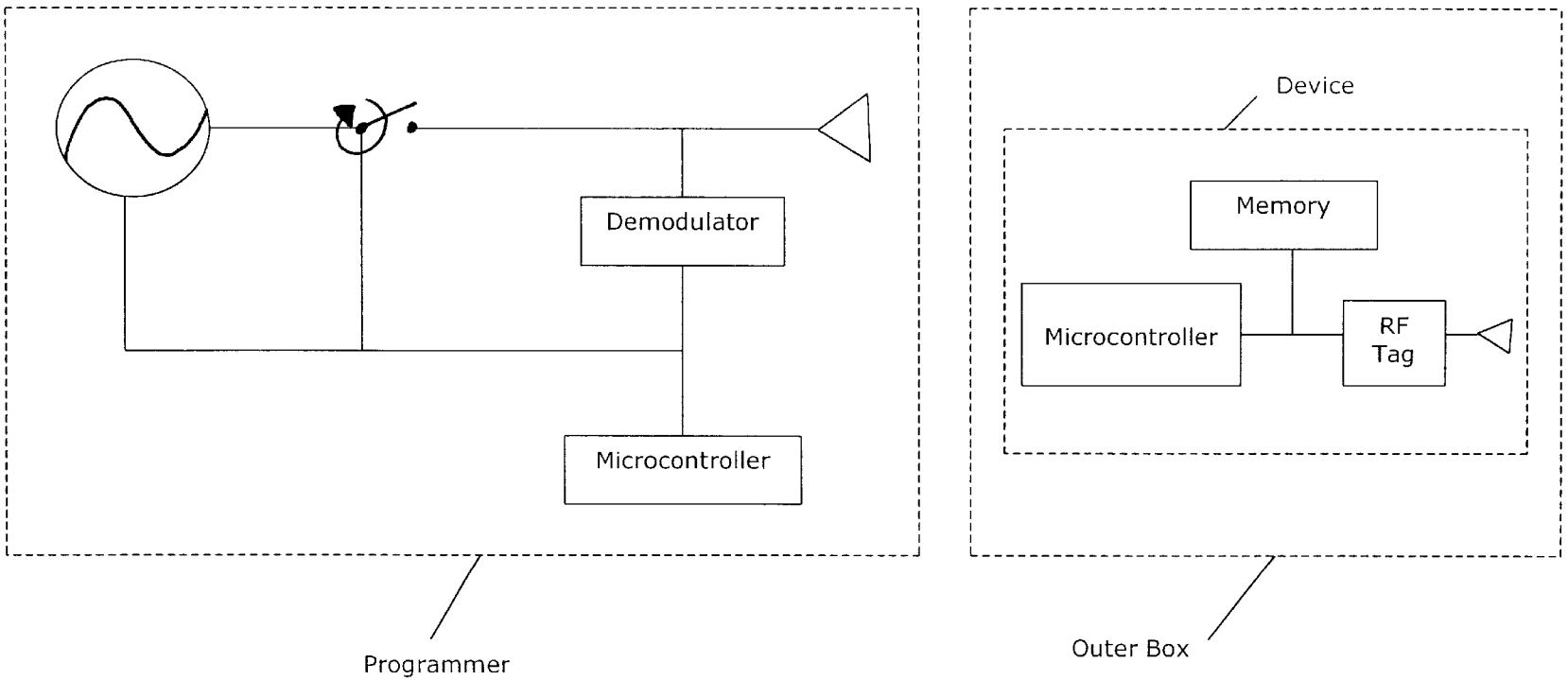
FIG. 13 is a block diagram of an RFID programmer and an embedded software programmable device with an onboard RFID tag.

Systems, as shown in FIG. 12, may comprise a programming device/software loader controlled by a micro controller and using an RF interface and antenna to interrogate and program RFID tags. The programmed RFID tag, brought into proximity with the targeted embedded software device, is then interrogated by the RF interface of the embedded device interpreting the data received from the RFID tag interrogation and allocating the data to proper locations in memory, thereby reprogramming the device. FIG. 13 shows a typical programmer in higher detail and also demonstrates that the embedded software device may have an RFID tag built into it. In this case, programming may be performed directly to the device mounted RFID tag through consumer packaging, without requiring energizing of the device. Reprogramming data is installed when the device directly interrogates the RFID tag for new information. This may occur through a user command or upon activation of the device.

The RFID may contain all necessary programming data or the software programmable product may be preloaded with all possible configurations, the download data indicating which configuration should be selected and applied for operation. Further, the download data may indicate a network address where a network connected software programmable device may access specific configuration/operation parameters. RFID configuration data is extracted and transferred utilizing protocol translation electronics and software.

A customer with a software programmable product and several RFID labels could quickly and easily reprogram the product for a wide range of configurations simply by selecting the proper RFID label and allowing it to reconfigure the product. This level of programmability has previously required either skilled technicians to replace memory chips, or extensive cabling and technical know-how to operate a data-transfer protocol, or a dedicated programming device, adding costs to the product, or a difficult-to-use interface on the product itself, limited by the lack of input means on a cost effective product user interface.

The present invention is entitled to a range of equivalents, and is to be limited in scope only by the following claims.

We claim:

1. A printer configurable by an RFID comprising:

a housing, supporting a printing mechanism having at least one configurable operating parameter, controlled by a control unit coupled to an RFID reader;

whereby a configuration data received by said RFID reader is passed to the control unit, setting the at least one operating parameter of the printing mechanism.

2. The printer of claim 1, wherein an RFID is located on a printer media, the RFID storing a printer media configuration data; the RFID removable for recycling.

3. The printer of claim 2, wherein the RFID reader is adapted to write a usage data related to the media roll onto the RFID.

4. The printer of claim 1, wherein the RFID reader is located within the housing, arranged to read a RFID located proximate to a media path.

5. The printer of claim 1, wherein the RFID reader is located within the housing arranged to read a RFID outside of the housing.

6. The printer of claim 1, wherein the RFID reader is arranged to read RFIDs located on a printer accessory proximate to the printer.

7. The printer of claim 1, wherein the printer is packaged in a container with at least one RFID attached to an outside surface of the container;

the RFID programmable with configuration data for configuring the printer.

8. A printer configurable by RFID comprising:

a housing supporting a printing mechanism controlled by a control unit coupled to a RFID;

whereby a configuration data received by said RFID is passed to the control unit, setting at least one operating parameter of the print mechanism.

9. The printer of claim 8, wherein the RFID can receive data without the printer being energized; the printer is adapted, upon energizing, to transfer data from the RFID to the control unit.

10. A software programmable product configurable by a RFID comprising:

a memory, the memory storing product operation software, the memory coupled to a control unit, the control unit coupled to a RFID;

the software configurable by data stored on the RFID.

11. The product of claim 10, wherein the RFID also functions as the memory.

12. A method for configuring a software programmable product comprising the steps of:

placing a RFID containing a configuration data proximate to a RFID reader coupled to the software programmable product;

initiating a read of the RFID by the RFID reader;

transferring configuration data received by the RF reader to a CPU of the software programmable product.

13. The method of claim 12, wherein the product is a printer.

14. The method of claim 12, wherein the product is one of a wireless communication device and a portable computing device.

15. The method of claim 12, wherein the configuration data comprises an identifier which the CPU uses to identify a specific configuration from a list of possible configurations.

16. A method for configuring a software programmable product with an onboard RFID, comprising the steps of:

locating the product within a read range of a RFID reader;

writing configuration data to the RFID;

transferring the configuration data from the RFID to a CPU of the product.

17. The method of claim 16, wherein the RFID reader is adapted to a consumer kiosk; the kiosk adapted to enable a consumer to choose desired configuration data.

18. The method of claim 16, wherein the configuration data includes wireless operation parameters for the product.

19. The method of claim 16 wherein the product is one of a printer, a cellular communications device, and a portable computer.

* * * * *